US008136470B1

(12) United States Patent
Buescher et al.

(10) Patent No.: US 8,136,470 B1
(45) Date of Patent: Mar. 20, 2012

(54) SYSTEM AND METHOD FOR MODIFYING THE NET BUOYANCY OF UNDERWATER OBJECTS

(75) Inventors: James Buescher, San Diego, CA (US); Peter Sullivan, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 132 days.

(21) Appl. No.: 12/793,321

(22) Filed: Jun. 3, 2010

(51) Int. Cl.
*B63G 8/14* (2006.01)

(52) U.S. Cl. ..... 114/330; 114/121

(58) Field of Classification Search ..... 114/121, 114/125, 312, 330, 331, 337; 367/16, 18, 367/106
See application file for complete search history.

(56) References Cited

U.S. PATENT DOCUMENTS 2,871,665 A * 2/1959 Brandt ..... 367/18
3,343,511 A * 9/1967 Hinton et al. ..... 114/330
3,437,065 A * 4/1969 Robbins, Jr. ..... 114/330
4,745,583 A * 5/1988 Motal ..... 367/18
2007/0135974 A1 6/2007 Fielding et al.
2007/0229083 A1 10/2007 Tenghamn et al.
2008/0145149 A1 6/2008 Grinsted et al.
2008/0264323 A1 10/2008 Gosling
2008/0300821 A1 12/2008 Frank et al.
2009/0241826 A1 10/2009 Vosburgh et al.

* cited by examiner

*Primary Examiner* — Lars A Olson
(74) *Attorney, Agent, or Firm* — Ryan J. Friedl; Kyle Eppele

(57) ABSTRACT

Buoyancy is controlled in a tethered object by pumping fluids, either of a first or second specific gravity, from an external source into either a first or second containment chamber to change the respective volumetric capacities of the first and second containment chambers. The containment chambers are configured such that the second chamber is at least partially enclosed within the first chamber. The second chamber is configured to expand and retract within the first chamber, which has a fixed housing. Expansion or contraction of the second chamber results in a corresponding inverse change in a volumetric capacity of the first chamber. The fluid chambers may be separate or contained within the same housing, and may be located on a towing vessel. Sensor data from the tethered object's environment may be used to control the transfer of fluid to the first and second chambers.

19 Claims, 5 Drawing Sheets

SYSTEM AND METHOD FOR MODIFYING THE NET BUOYANCY OF UNDERWATER OBJECTS

FEDERALLY-SPONSORED RESEARCH AND DEVELOPMENT

The System and Method for Modifying the Net Buoyancy of Underwater Objects is assigned to the United States Government and is available for licensing for commercial purposes. Licensing and technical inquiries may be directed to the Office of Research and Technical Applications, Space and Naval Warfare Systems Center, Pacific, Code 72120, San Diego, Calif., 92152; phone number (619) 553-2778; email address ssc_pac_T2@navy.mil. Reference Navy Case Number 100109.

BACKGROUND

Previous methods for modifying the buoyancy of submerged objects have involved varying the volume of the object while holding the mass of the object constant or nearly constant. Pneumatically actuated ballast systems work in this way, as do mechanically actuated buoyancy pumps. Both of these methods achieve the result of altering the net density of the submerged object, which is equivalent to the displaced volume of the object divided by its mass. Additionally, dynamic lifting surfaces affixed to the submerged object have previously been used to control the position of the object relative to a towing platform. Dynamic lifting surfaces have the disadvantage of generating additional drag to produce lift which can counteract the buoyancy of the submerged object. They also require relative velocity between the submerged object and the submerging water, and hence do not work with the submerged object at rest.

The previously described methods create difficulties when implemented with small objects, such as small towed objects. Both pneumatically actuated and mechanically actuated volume-varying buoyancy systems can be impractical to implement on submerged objects having small dimensions, or which must operate at great depths, and thus are exposed to high external pressure. The previously described techniques may also be mechanically incompatible with certain towed objects, particularly small diameter sensor arrays. Other problems include use in environments in which it is impractical or problematic to store or generate the high pressure gas required by a pneumatic system.

SUMMARY OF SOME EMBODIMENTS

Buoyancy in a tethered object is achieved by controlling fluid in a pair of containment chambers. A first containment chamber is provided in the object. A second containment chamber and having a variable volume achieved by expanding or contracting is provided at least partially within the first containment chamber. The expansion or contraction within the second containment chamber results in a corresponding inverse change in a volumetric capacity of the first containment chamber as a result of a change of volume of the second containment chamber within the volume of the first containment chamber. First and second fluid connections connect the first and second containment chambers to respective first and second fluid supplies and are least partially fixed to a tether for the vehicle. The fluid connections permit separate transfer of fluid between the first and second containment chambers and their respective fluid supplies.

A pump is used to move fluid into at least one of the first and second containment chambers. The first and second chambers provide a buoyancy adjustment mechanism, wherein providing a first fluid, having a first specific gravity, in the first containment chamber and providing a second fluid, having a second specific gravity, in the second containment chamber results in a change in the buoyancy of the tethered object. The change in specific gravity corresponds to the change in volumetric capacities of the first and second containment chambers.

DETAILED DESCRIPTION OF SOME EMBODIMENTS

Figure 1:
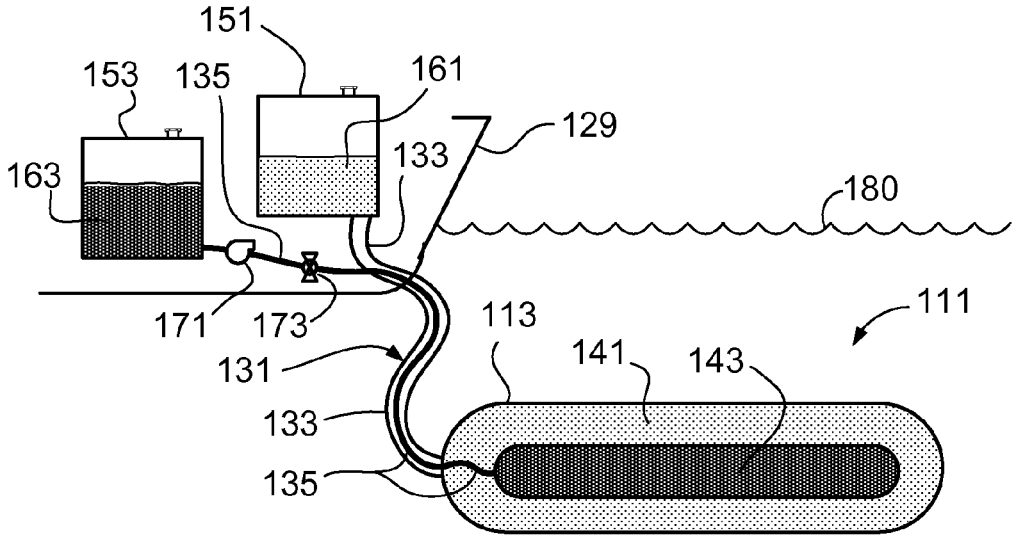
FIG. 1 shows a diagram of an example configuration of a towed underwater object constructed to contain outer and inner containment chambers.

Changing the net density of an object by varying its mass while holding volume to be constant requires an adaptation to the laws of physics as expressed by the principle of mass/matter conservation. In a submarine, this is ordinarily achieved by admitting or expelling seawater into a ballast tank, resulting in compression or expansion of air in the airspace remaining in the bladder. The water is admitted and expelled by pumps, with air exhausted through vents or pumped into compressed air tanks. In the case of towed underwater objects, it is desired that the change in net density be accomplished externally, which reduces the complexity of the ballast system.

In the case of an untethered submarine, all systems are internal, so that a change in net density is accomplished by pumping air between an air tank and a bladder or possibly between a snorkel and a bladder. "Externally" changed is intended to mean that changes in net density are accomplished by systems which have major components external of the towed underwater object, an example being components located on a towing vessel. Since a towed underwater object is generally tethered, it is possible to use the tether as a part of a connection to an external system for changing buoyancy of the towed underwater object.

The present approach envisions that some part of the total system remain external to the submerged object in order to facilitate the transfer of mass to and from the object. For this reason, the disclosed technique lends itself well to towed objects, where a connection to the towing platform provides external means by which mass may be transferred to and from the submerged object.

The disclosed techniques provide means by which the net buoyancy of a towed underwater object can be altered to allow the net buoyancy of that object to be always neutral (neither positively or negatively buoyant) in spite of changes in the actual density of the water in which the object is submerged. Changes to the density of the submerging water are effected by variations in depth, temperature, and salinity.

The net buoyancy of the towed object is altered by varying the mass of the object while holding its displaced volume constant. The mass of the object is varied by transferring a ballast fluid which is heavier than water into or out of an expandable containment chamber or containment chambers located within the submerged object. This heavy ballast fluid, in being transferred to or from the expandable containment chamber, causes an exchange of buoyant (lighter than water) fluid to occur as well, and in so doing, the displacement of the submerged object is held fixed. A connection to a point external to the submerged object allows fluid communication with further containments where the light and heavy ballast fluids are stored and from which they are transferred to and from the submerged object. By holding the net buoyancy of the submerged object neutral, the position of the submerged object relative to the towing platform and the attitude of the submerged object can be more easily controlled and hydrodynamic drag exerted on the tow platform by the submerged object may be minimized. In addition, the position of the submerged object at rest is more easily controlled.

The design of the system is such that in certain embodiments, all of the system components may be fluid compensated and directly equalized to ambient pressure. As such, the disclosed techniques may be operated while submerged at any depth without causing excessive mechanical stress upon, or failure of, the individual components.

The buoyant (lighter than water) fluid which is partially exchanged to maintain neutral buoyancy of the submerged object may also be used to provide offsetting buoyancy for items mounted on or within the submerged object. These items may include, but are not limited to, sensors, valves, pumps, or electronic controllers for the aforementioned.

FIG. 1 shows a diagram of an example configuration in which an underwater object 111 comprises an outer shell 113 which forms a fixed volume housing. The underwater object 111 is towed through the water by a platform, boat, or other device 129, by means of a conduit/tether 131. The conduit/tether 131 is formed to comprise a primary conduit 133. A secondary conduit 135 is provided within the primary conduit 133 or is otherwise collocated with the primary conduit 133 or the tether 131.

Underwater object 111 is constructed to contain outer and inner containment chambers 141 and 143, respectively, which provide the function of a ballast tank. Outer shell 113 forms an outer component of outer containment chamber 141, with inner containment chamber 143 held within outer shell 113. Inner containment chamber 143 is provided as an expandable containment chamber, with the expandable portion of inner containment chamber 143 expanding within the outer containment chamber 141.

Thus, outer and inner containment chambers 141 and 143 are collocated within the fixed-volume housing defined by outer shell 113. The arrangement is such that the total volume capacity of the outer and inner containment chambers 141 and 143 can be predetermined, and therefore expansion of inner containment chamber 143 will decrease the capacity of outer containment chamber 141 by the same volume, and vice-versa. In the case of the outer shell 113 being of a fixed volume, the inner containment chamber 143 and the outer containment chamber 141 have a fixed total volume. It is possible to provide a volume adjustment device for underwater object 111, in which case the total volume within outer shell 113 could change. However, for any fixed given total volume, a change in the volume of inner containment chamber 143 will result in a corresponding inverse change in volume of outer containment chamber 141.

Within towing device 129 are two fluid supply reservoirs 151 and 153. The first fluid supply reservoir 151 is directly connected to the fixed-volume housing defined by outer shell 113 of underwater object 111 by way of primary conduit 133. Within first fluid supply reservoir 151, primary conduit 133, and outer shell 113 is a fixed volume of low specific gravity (SG) fluid 161, having density less than water. In one embodiment, this low SG fluid 161 could be mineral oil or a synthetic paraffinic fluid. However, other fluids, such as most alcohols, may also be used. Non-limiting examples of synthetic paraffinic fluids include Isopar™ M-naphtha isoparaffin fluid, which has a density of 788 kg/$M^3$, and Isopar™ V-fluid, which has a density of 819 kg/$M^3$, both sold by ExxonMobil Chemical.

The low SG fluid 161 exists in sufficient volume to completely fill the fixed-volume housing defined by outer shell 113 and primary conduit 133, but only to partially fill reservoir 151. This allows the level of fluid in reservoir 151 to change as necessary. Second fluid supply reservoir 153 contains a high SG fluid 163, which has a density greater than water. Second fluid reservoir 153 is connected to a controllable displacement metering pump 171 and a gate valve 173, which control the flow of fluid 163 into secondary conduit 135. Within second reservoir 153, secondary conduit 135, and expandable inner containment chamber 143 is a fixed volume of the high SG fluid 163. An example of a high SG fluid 163 is single phase Fluorinert™, supplied by 3M. Fluorinert is a stable fluorocarbon-based fluid. An example is Fluorinert FC-40, which comprises perfluoro compounds, primarily compounds with 12 carbons, having a density of 1855 kg/$m^3$@25° C. Other Fluorinert compounds are available which comprise perfluoro compounds, primarily with a number of carbons ranging from 6 to 15.

Components or instruments (e.g., devices 352, 356, 358 described in connection with FIG. 3) may be exposed to the fluid in outer containment chamber 141. By providing a suitable fluid, for example the low SG fluid 161, the components are protected from electrolytic effects of water.

While the low SG fluid 161 is described as being used to fill outer containment chamber 141 and the high SG fluid 163 is described as being used to fill inner containment chamber 143, it is understood that the described techniques will work with the high SG fluid 163 used to fill the outer containment chamber 141 and the low SG fluid 161 used to fill the with inner containment chamber 143. This would result in an opposite change in buoyancy, as the expansion of the inner containment chamber 143 with low SG fluid 161 would result in decreased buoyancy.

In the first configuration, described by FIG. 1, expandable inner containment chamber 143 contains enough heavy high SG fluid 163 to allow the total mass of the submerged object 111 to be equal to the total mass of the submerging water that is displaced by the fixed volume of submerged object 111. This renders the submerged object 111 neutrally buoyant. The pump 171 and valve 173 are not active.

The buoyancy or relative density of submerged object 111 with respect to water 180 may change for a number of reasons. First, the initial weight of submerged object 111 may vary from unit to unit. Beyond that, buoyancy can change because of changes in water temperature, salinity, changes in the payload of the submerged object, pressure, and desired depth of submerged object 111.

Figure 2:
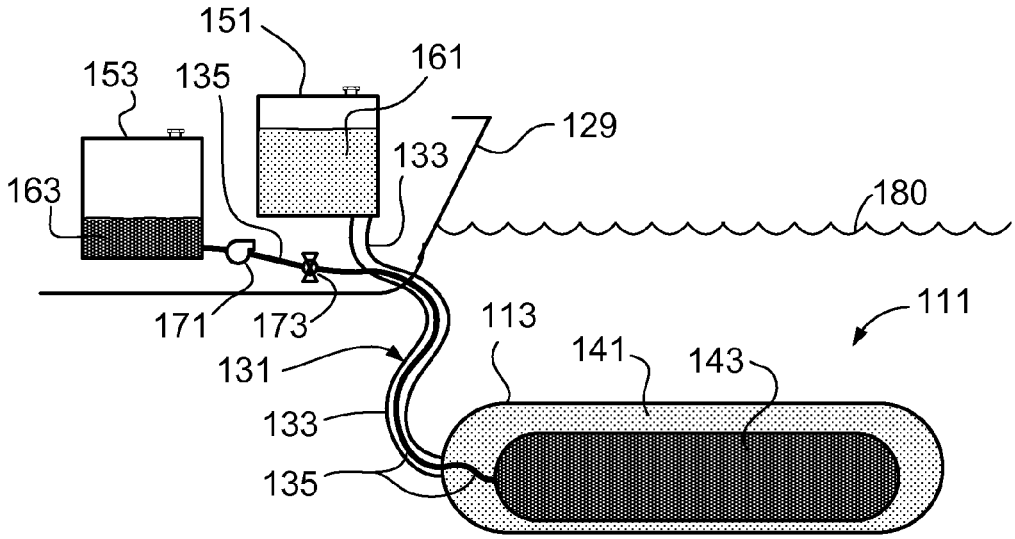
FIG. 2 shows a diagram of the system as would appear after adjustment to establish a higher specific gravity than shown in FIG. 1.

FIG. 2 shows a diagram of the system as would appear after being placed in water which is of a higher density than shown in FIG. 1. This increase in density could be due to any of the above-mentioned factors, such as a change in temperature, pressure, and/or salinity of the submerging water. Because the density of the water has increased, the mass of submerging water that is displaced by the fixed volume of the outer shell 113 will have also increased. In order to maintain neutral buoyancy, the mass of submerged object 111 must be increased to match the new mass of the displaced water. This has been accomplished by opening the valve 173 and controllably transferring a known volume of heavy high SG fluid 163 via the pump 171 through the secondary conduit 135 and into expandable inner containment chamber 143. This volume of heavy fluid has caused expandable inner containment chamber 143 to increase in volume. Because the outer shell 113 of submerged object 111 is of fixed volume, the expansion of expandable inner containment chamber 143 has exerted pressure on the light low SG fluid 161 within submerged object 111 and caused a volume of light low SG fluid 161 equal to the volume of heavy high SG fluid 163 transferred by the pump 171 to be passed via the primary conduit 133 into first reservoir 151 from outer containment chamber 141. The level of light low SG fluid 161 in reservoir 151 is seen to have increased while the level of heavy high SG fluid 163 in reservoir 153 is seen to have decreased. Because of this exchange, the net mass of submerged object 111 is now equal to the mass of water displaced by the volume of that object, even though the density of the water has changed. After the transfer is complete the valve 173 is closed.

In the case of encountering submerging water which is again of lesser density due to changes in salinity, pressure, and/or temperature, the process can be reversed. By opening valve 173 and pumping a known volume of heavy high SG fluid 163 back into reservoir 153 with pump 171, an equal volume of light low SG fluid 161 will be drawn from reservoir 151 back into the fixed-volume housing 113. This exchange will cause the net mass of the submerged object to decrease, and can be controllably set to allow buoyancy equilibrium over a wide range of submerging water densities, provided an adequate reserve of both low SG fluid 161 and high SG fluid 163.

It is also noted that the towing of submerged object 111 from a surface vessel (e.g., boat 129) results in an upward pull on submerged object via tether 131. While the upward force can be counteracted by fins or dynamic lifting surfaces (not shown) or the general shape of submerged object 111, adjustments in buoyancy can be used to control sink rate or move submerged object 111 upward toward the water surface 180.

High SG fluid 163 is used in expandable inner containment chamber 143 in the example because it is considered to be more efficient to move the high SG fluid 163 in and out of expandable inner containment chamber 143 in order to make adjustments. However, it is possible to adjust buoyancy by use of a low SG fluid in expandable inner containment chamber 143 and a high SG fluid in outer containment chamber 141. The low SG fluid is likely to have the largest volume, and so using the low SG fluid in outer containment chamber 141 may be convenient from the viewpoint of maximizing useful space in submerged object 111.

It is also possible to fill one or both of the outer and inner containment chambers 141 and 143 so that another fluid is entrained in the containment chamber. This would result in an initial modification of the buoyancy of submerged object 111. The additional fluid may be separated, for example by a flexible membrane (not shown) within containment chamber 141 or 143 or may be allowed to remain separated by virtue of the physical properties of the additional fluid and the high or low SG fluid 161 or 163.

Figure 3:
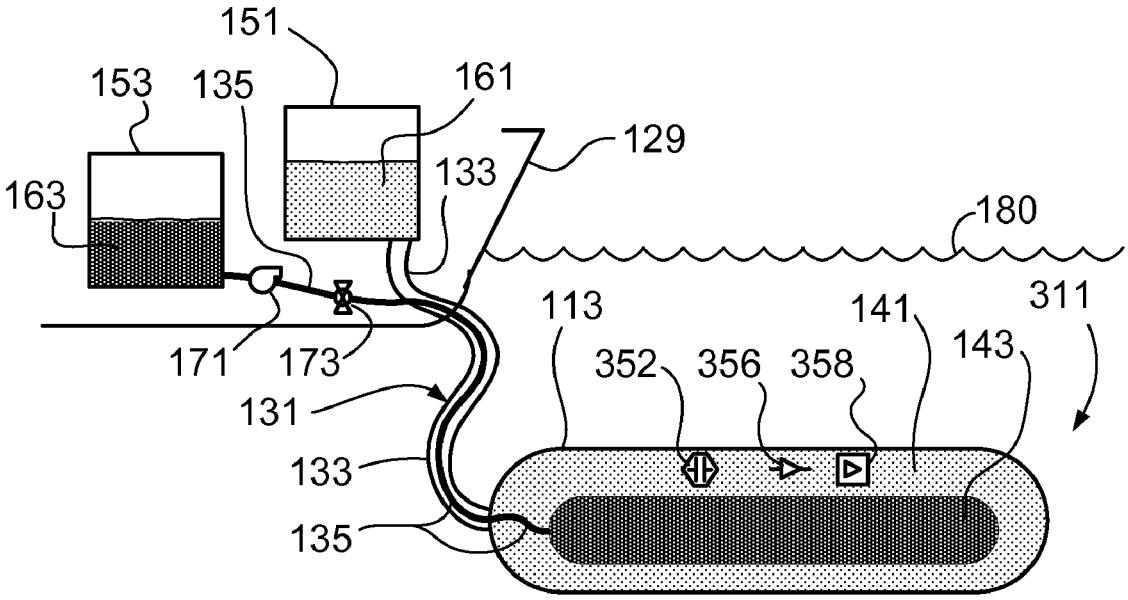
FIG. 3 shows a diagram of a configuration in which a submerged object has a capability of sensing conditions related to buoyancy.

FIG. 3 shows a diagram of a configuration in which a submerged object 311 has a capability of sensing conditions related to buoyancy. A Conductivity, Temperature and Depth (CTD) sensor 352 provides information which is relayed to the towing device 129 via data lines (not separately shown) integrated with the conduit/tether 131 and used as input to controllably adjust the net mass of submerged object 311. CTD sensor 352 provides information related to the mineral content (salinity) of water, as well as temperature and pressure, which is used to provide a reading of the specific gravity of the water, as well as the depth of submerged object 311.

FIG. 3 also depicts the use of sensors 356 and control electronics 358 for sensors 356 that may be placed within submerged object 311. In the case where these sensors 352, 356, and controllers 358 indicate the submerged object is heavy and would tend to sink, an adequate volume of light-low SG fluid 161 could be carried in the fixed-volume housing 113 to provide buoyancy which would support/float the devices. The CTD sensor 352 may also be used to control submerged object 311. This information provided by the CTD sensor 352 is used either internally (within submerged object 311) or externally to provide information regarding the specific gravity of the water and thereby control the specific gravity of submerged object 311.

The electronic components 352, 356, 358 may be exposed or partially exposed to one of the fluids, shown in the example as low SG fluid 161.

Figure 4:
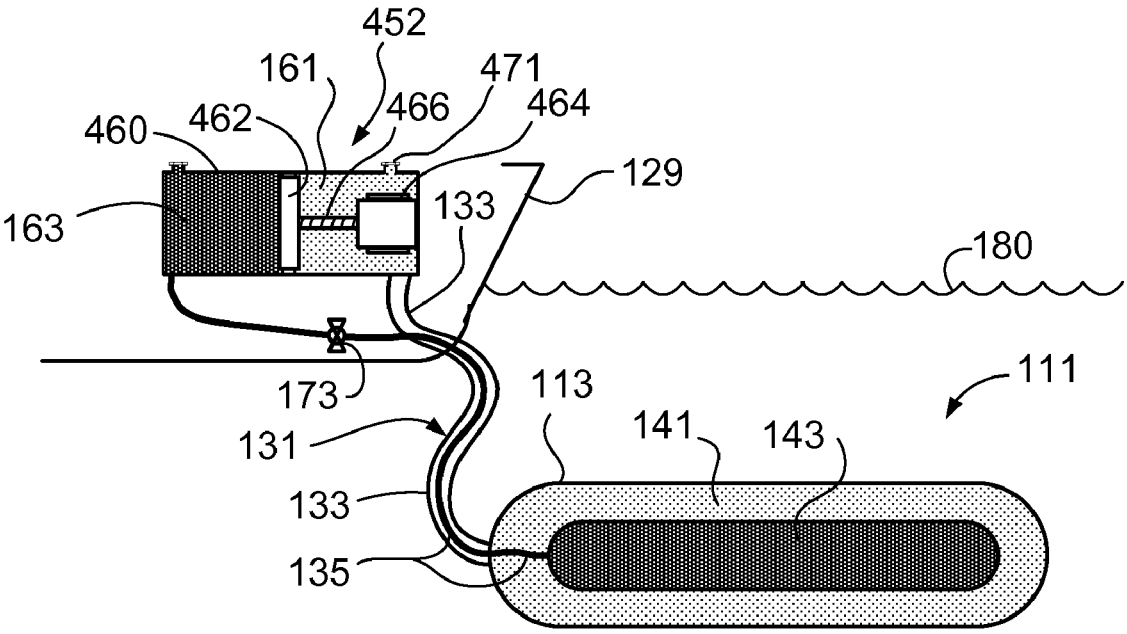
FIG. 4 shows a diagram of configuration using a single, self-contained pump and reservoir device.

FIG. 4 shows a diagram of a configuration in which the dual reservoir and pump system of FIGS. 1-3 has been replaced by a single, self-contained pump and reservoir device 452. In this embodiment, a single housing 460 contains a sealed, moveable piston 462 which is connected to drive motor 464 by linear actuator 466. In one configuration, drive motor 464 could be a brushless electric motor and the linear actuator 466 could be a ballscrew assembly. Moveable piston 462 separates one portion of the device which is filled with light low SG fluid 161 from the portion of the device which is filled with heavy high SG fluid 163.

When the motor 464 is activated, the piston 462 is propelled by the linear actuator 466 which presses on the fluid in the cavity of the housing 460 that is being shortened due to the travel of the piston. If the valve 173 is open, then the fluid will be pumped out of that chamber. On the opposite side of the housing 460, the other fluid will be drawn into the space which is being expanded by piston 462 as the fluid is forced out of either the outer shell 113 (outer containment chamber 141) or inner containment chamber 143. In this embodiment the motor 464 and actuator 466 reside within and may be pressure compensated by the volume of light low SG fluid 161. Piston 462 may be controllably moved by motor 464 and actuator 466 in both directions and by measuring the displacement of piston 462, the volume of fluid transferred may be known.

The reservoir device 452 may have a vent or accumulator, e.g., through cap 471, to permit expansion and contraction. The vent or accumulator may be on one side of the reservoir device 452, since equilibrium can occur through the expansion and contraction capability of the inner containment chamber 143. Placing the vent on one side allows the other side (e.g., reservoir fluid 163, secondary conduit 135 and containment chamber 143) to function as a closed system. The vent should be placed on a side of the pump and reservoir device 452 which normally operates at a lower pressure in order to reduce a propensity for creation of vacuum cavitation pockets. If an accumulator is used, one or both sides may have an accumulator, because the use of the accumulator does not break the closed nature of the fluid system beyond the expansibility of the accumulator.

Figure 5:
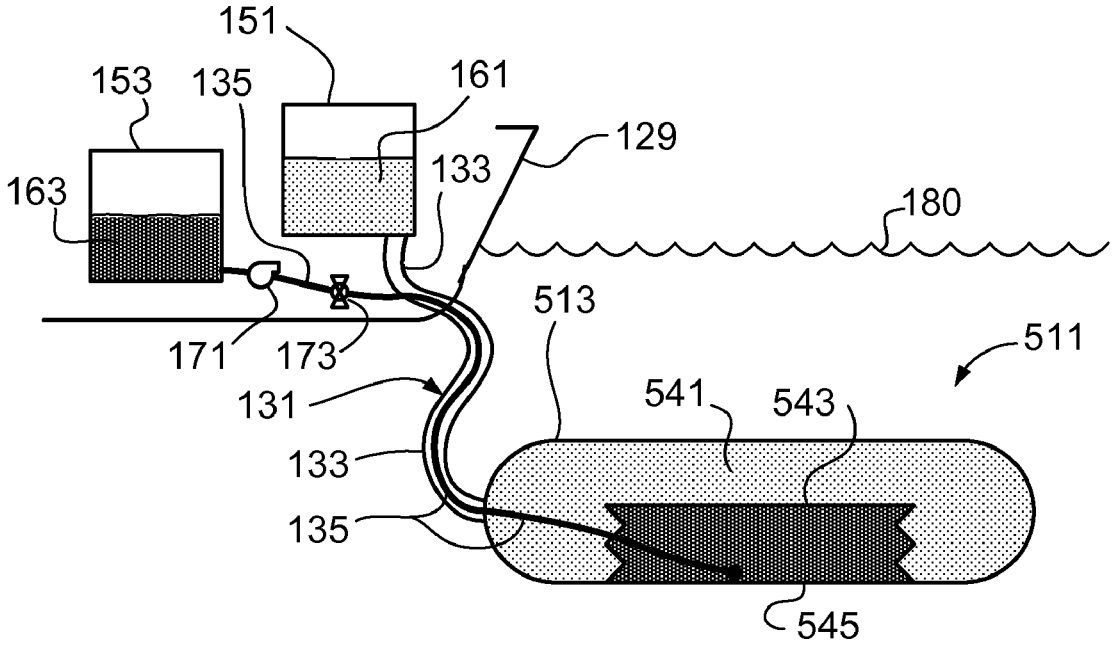
FIGS. 5-6 show diagrams of configurations of a submerged object in which outer and inner containment chambers share a common wall, with FIG. 5 depicting the use of two supply reservoirs and FIG. 6 depicting the use of a single, self-contained pump and reservoir device.
Figure 6:
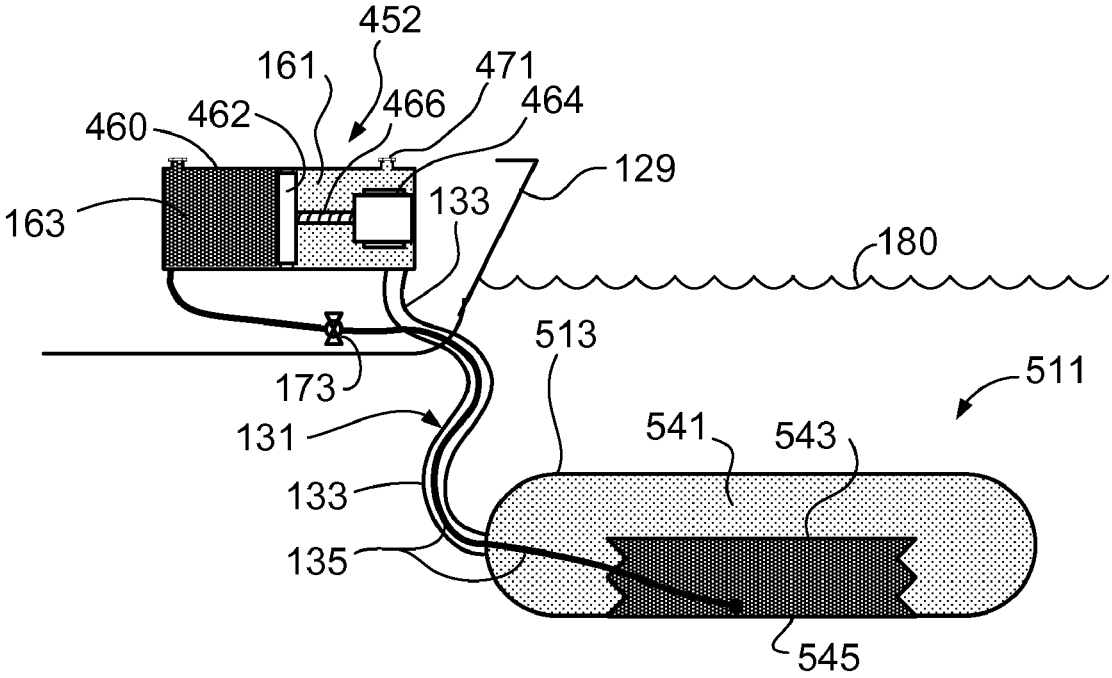

While inner containment chamber 143 is depicted in FIGS. 1-4 as fully enclosed by outer containment chamber 141, it is possible for the containment chambers 141 and 143 to share an outer wall. FIGS. 5 and 6 show diagrams of configurations of a submerged object 511 in which an outer shell 513 encloses outer containment chamber 541 and inner containment chamber 543. Outer and inner containment chambers 541 and 543 share common wall 545. By way of non-limiting example, common wall 545 is also shared with outer shell 513. Inner containment chamber 543 expands within outer containment chamber 541 where outer and inner containment chambers 541 and 543 do not share common wall 545.

While inner containment chamber 543 is shown as expandable entirely within outer containment chamber 541, it is possible to permit inner containment chamber 543 to also expand outside of outer containment chamber 541.

Figure 7:
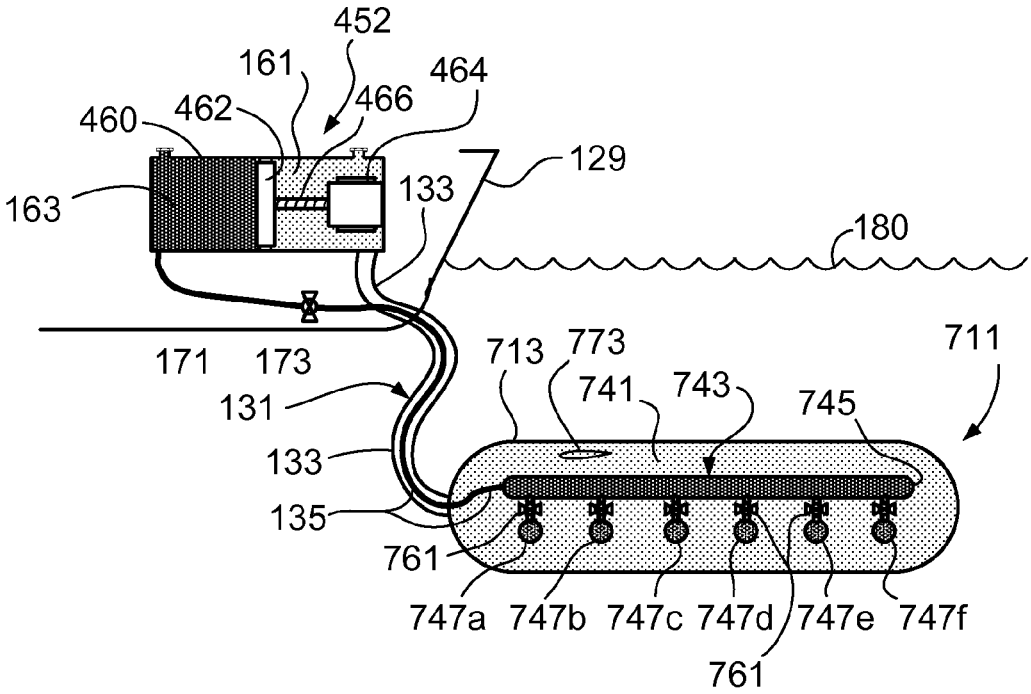
FIG. 7 shows a diagram of a submerged object in which an inner containment chamber comprises a main manifold bladder and discrete bladders.

FIG. 7 shows a diagram of the system of FIG. 4, but where the system of FIG. 4 (and FIGS. 1-3) utilizes a single expandable reservoir within the submerged object 711, the system of FIG. 7 utilizes a plurality of discrete bladders. Depicted is the submerged object 711, which is constructed to contain outer and inner containment chambers 741 and 743, respectively, in which outer shell 713 forms an outer component of outer containment chamber 741. Inner containment chamber 743 comprises a main manifold bladder 745 and discrete bladders 747*a*-747*f*. Discrete bladders 747*a*-747*f* are separately valved with individual control valves 761. While six discrete bladders 747*a*, 747*b*, 747*c*, 747*d*, 747*e*, 747*f* are described, this is only an example, and the arrangement also functions with a different number of bladders.

As is the case with the configurations of FIGS. 1-4, outer and inner containment chambers 741 and 743 are configured such that the total volume capacity of the outer and inner containment chambers 741 and 743 can be predetermined. Thus, expansion of inner containment chamber 743 will decrease the capacity of outer containment chamber 741 by the same volume, and vice-versa. In this case, the expansion of inner containment chamber 743 is accomplished through discrete bladders 747*a*-747*f*. For any given total volume, a change in the volume of the inner containment chamber 743 (main manifold 745 plus discrete bladders 747*a*-747*f*) will result in a corresponding inverse change in volume of outer containment chamber 741.

Figure 8:
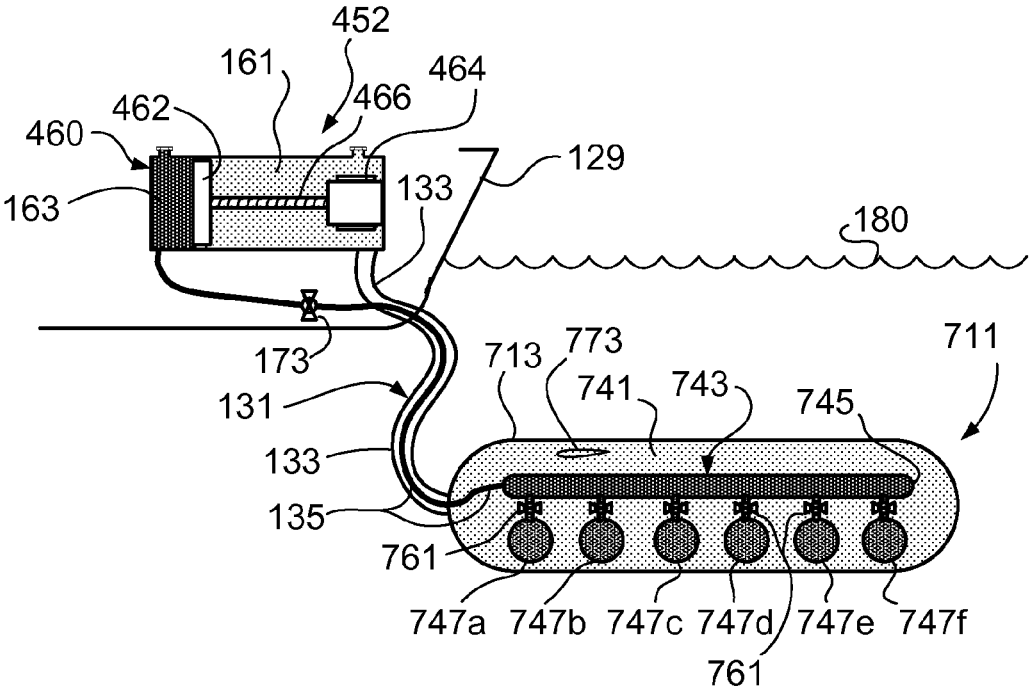
FIG. 8 shows a diagram of the submerged object of FIG. 7 in which the discrete bladders are expanded.

Individual control valves 761 gate the flow of heavy high SG fluid 163 into bladders 747*a*-747*f*. As shown in FIG. 8, individual control valves 761 may be opened simultaneously to allow heavy low SG fluid 161 to flow into the discrete bladders 747*a*-747*f*, causing discrete bladders 747*a*-747*f* to expand, displacing light low SG fluid 161 via the primary conduit 133 back into reservoir device 452. The volume of submerged object 711 is again held fixed by outer containment chamber 741.

Figure 9:
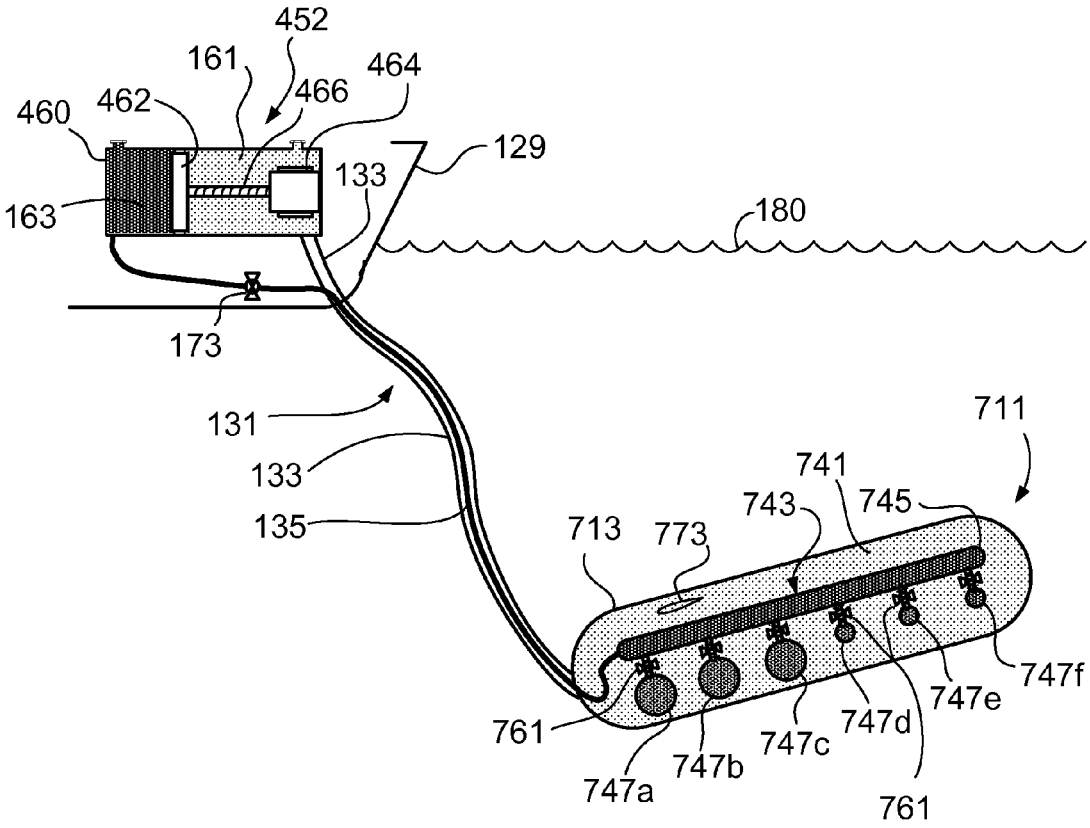
FIG. 9 shows a diagram of the submerged object of FIG. 7 in which the discrete bladders are used to adjust the attitude of submerged object.

FIG. 9 shows a diagram illustrating the use of discrete bladders 747*a*-747*f* to adjust the attitude of submerged object 711. In addition to changing the net mass of the submerged object 711, discrete bladders 747*a*-747*f* can be used to shift the center of mass of submerged object 711, thereby adjusting its attitude. By selectively opening a subset of control valves 761, heavy high SG fluid 163 may be added to a subset of discrete bladders, depicted in FIG. 9 as bladders 747*a*-747*c*, causing a shift in the center of mass of submerged object 711. Because the volume is fixed, the buoyancy of submerged object 711 remains fixed and the alteration of the center of mass causes a change in the orientation of submerged object 711. This attitude modification may be conducted independently of or in conjunction with changes to the net mass of submerged object 711 as previously described. It is noted, however, that the change in the center of gravity requires that fluid be pumped to effect the change.

The change in attitude of submerged object 711 can augment the effect of fins or dynamic lifting surfaces 773 or the general shape of submerged object 711, such that a change in attitude will also affect the angle of attack of submerged object 711.

The described techniques have the advantage of working for rigid as well as non-rigid submerged bodies. The system works to change the net buoyancy of a submerged object even when the object is completely static in the submerging fluid. The disclosed techniques can be applied to submerged objects which may be of small or unusual shape, and which are unsuitable for the direct attachment of pneumatically or mechanically activated buoyancy changing pumps. The technique can be adapted to a full range of operating depths without impacting the basic size or mechanical properties of the components.

The techniques permit changing the net density of a towed submerged object by varying its mass while holding volume to be constant. The techniques further permit varying the net mass of a submerged object by controllably transferring ballast fluids of multiple densities.

Many modifications and variations of the System and Method for Modifying the Net Buoyancy of Underwater Objects are possible in light of the above description. Within the scope of the appended claims, the embodiments of the systems described herein may be practiced otherwise than as specifically described. The scope of the claims is not limited to the implementations and the embodiments disclosed herein, but extends to other implementations and embodiments as may be contemplated by those having ordinary skill in the art.

We claim:

1. A system comprising:

a first containment chamber disposed within a tethered object, the first containment chamber having a fixed housing;

a second containment chamber at least partially enclosed within the first containment chamber, the second containment chamber configured to expand and contract within the first containment chamber;

a first fluid supply, external to the tethered object, having a first fluid disposed therein and connected to the first containment chamber by a first fluid connection device;

a second fluid supply, external to the tethered object, having a second fluid disposed therein and connected to the second containment chamber by a second fluid connection device, wherein the second fluid has a different specific gravity than the first fluid; and a pump configured to pump at least one of the first fluid and the second fluid into at least one of the first containment chamber and the second containment chamber via the respective first fluid connection device or the second fluid connection device.

2. The system of claim 1, wherein the first containment chamber fully encloses the second containment chamber.

3. The system of claim 1, wherein the pump is connected to at least one of the first fluid connection device and the second fluid connection device.

4. The system of claim 1, wherein the first fluid connection device and the second fluid connection device are at least partially fixed to a tether connected to the tethered object.

5. The system of claim 1, wherein the first fluid has a density less than the density of water and the second fluid has a density greater than the density of water.

6. The system of claim 5, wherein the first fluid is selected from the group of fluids consisting of a mineral oil, an alcohol, and a synthetic paraffinic fluid.

7. The system of claim 5, wherein the pump is connected to the second fluid connection device.

8. The system of claim 7, wherein the second fluid supply, the second fluid connection device, and the second containment chamber form a closed system.

9. The system of claim 1, wherein the first fluid supply and the second fluid supply are contained within a reservoir housing.

10. The system of claim 9, wherein the pump is located within the reservoir housing.

11. The system of claim 10, wherein the pump comprises a piston connected to a driver motor by a linear actuator, wherein the piston separates the first fluid supply from the second fluid supply.

12. The system of claim 1, further comprising:

a conductivity, temperature and depth (CTD) sensor configured to provide data concerning a surrounding environment for the tethered object; and a controller, connected to the CTD sensor, configured to control movement of at least one of the first fluid and the second fluid to a respective first containment chamber or second containment chamber responsive to the data provided by the CTD sensor.

13. The system of claim 1, wherein the second containment chamber comprises:

a main supply manifold; and a plurality of discrete expandable chambers connected to the main supply manifold by individual control valves.

14. A method comprising the steps of:

providing a first containment chamber connected to a first fluid supply by a first fluid connection device, the first fluid supply having a first fluid of a first specific gravity therein, the first containment chamber having a fixed housing and a second containment chamber fully contained therein, the second containment chamber expandable within the first containment chamber;

connecting a second fluid supply to the second containment chamber using a second fluid connection device, the second fluid supply having a second fluid of a second specific gravity therein, the second specific gravity different from the first specific gravity; and controlling the net buoyancy of the first containment chamber by changing the amount of the first fluid and the second fluid in the respective first and second containment chambers.

15. The method of claim 14 further comprising the steps of:

using a conductivity, temperature and depth (CTD) sensor, contained within the first containment chamber, to provide data concerning a surrounding environment for the first containment chamber; and controlling movement of the first fluid and the second fluid to respective first and second containment chambers responsive to the data provided by the CTD sensor.

16. The method of claim 14, wherein the first fluid has a density less than the density of water and the second fluid has a density greater than the density of water.

17. A method comprising the steps of:

providing a tethered object having a first containment chamber and a second containment chamber at least partially enclosed within the first containment chamber;

using external fluid supplies for the first and second containment chambers to provide a first fluid, having a first specific gravity, in the first containment chamber and to provide a second fluid, having a second specific gravity, in the second containment chamber; and using the external fluid supplies to vary a volume of the second containment chamber by expanding or contracting the second containment chamber within the first containment chamber, causing a corresponding inverse change in a volumetric capacity of the first containment chamber wherein the first and second containment chambers provide a buoyancy adjustment corresponding to the change in volumetric capacities of the first and second containment chambers.

18. The method of claim 17, wherein the first and second containment chambers are disposed within a tethered object, the method further comprising the steps of:

providing the external fluid supplies on a towing vessel connected to the tethered object by a tether;

using first and second fluid connections to connect the first and second containment chambers to their respective external fluid supplies, the first and second fluid connections at least partially fixed to the tether; and using a pump to effect a relative change between the capacities of the first and second containment chambers by pumping the respective first fluid or second fluid through one of the first and second fluid connections.

19. The method of claim 18, wherein the pump and the external fluid supplies are contained within a reservoir housing, wherein the pump comprises a piston connected to a driver motor by a linear actuator, wherein the piston separates the first fluid from the second fluid.

* * * * *